US005954550A

United States Patent [19]

Sheridan et al.

[11] Patent Number: 5,954,550

[45] Date of Patent: Sep. 21, 1999

[54] ELECTRICAL TERMINAL WITH ON-RAMP

[75] Inventors: Mark W. Sheridan, Mansfield, Ohio; Clifton Wade, III, Florissant, Mo.; Phillip W. Hill, Paragould, Ark.

[73] Assignee: Emerson Electric Co., St. Louis, Mo.

[21] Appl. No.: 08/953,471

[22] Filed: Oct. 17, 1997

Related U.S. Application Data

[60] Provisional application No. 60/028,632, Oct. 18, 1996.

[51] Int. Cl.[6] ..... H01R 9/24

[52] U.S. Cl. ..... 439/884; 439/849

[58] Field of Search ..... 439/884, 889, 439/845

[56] References Cited

U.S. PATENT DOCUMENTS

| | | | |
|---|---|---|---|
| 2,591,009 | 4/1952 | Riche | 439/845 |
| 3,148,012 | 9/1964 | Patton | 439/849 |
| 3,422,395 | 1/1969 | Fisher | 439/889 |
| 3,588,862 | 6/1971 | Brizzi | 439/889 |
| 4,713,026 | 12/1987 | Mobley et al. | 439/845 |
| 4,747,794 | 5/1988 | Seidler | 439/857 |

FOREIGN PATENT DOCUMENTS

| | | |
|---|---|---|
| 1278140 | 10/1961 | France . |
| 1337372 | 8/1963 | France . |
| 1 907 435 | 3/1969 | Germany . |

*Primary Examiner*—Neil Abrams
*Assistant Examiner*—T C Patel
*Attorney, Agent, or Firm*—Howell & Haferkamp, L.C.

[57] ABSTRACT

A male electrical terminal plug for attachment with a female electrical receptacle having a tab with opposite top and bottom surfaces, opposite distal and proximate ends perpendicular to the longitudinal axis of the tab, opposite side ends or edges perpendicular to the lateral axis of the tab, and a portion of the top surface area of the tab between opposite lateral side edges of the tab being sloped or angled relative to the remaining portion of the tab top surface from a base potion of the tab toward a beveled leading edge of the distal end of the tab.

20 Claims, 3 Drawing Sheets

ELECTRICAL TERMINAL WITH ON-RAMP

This application claims the benefit of U.S. Provisional Application No. 60/028,632 filed on Oct. 18, 1996.

BACKGROUND OF THE INVENTION

The present invention relates to electrical terminals and, more particularly, to male blade-type electrical plugs having angled or sloped portions or "on-ramps" formed therein to facilitate manual electrical connections with female electrical receptacles.

FIGS. 1A–1D illustrate a prior art male blade-type electrical plug, generally designated by the reference numeral 20. This type of plug is commonly used in start switches for electric motors. The male plug 20 includes a narrow tab 22 and a wide tab 24 with means for attaching an electrical conductor in the form of a pair of tabs 25 that could receive female connectors or could have conductors soldered directly thereto. The wide tab 24 has a locking hole 26 centered between opposite lateral side edges 28 and extending through the tab. As best shown in FIG. 1D (View A—A), the wide tab 24 has a tapered leading edge 30, including a beveled top edge 32 and a beveled bottom edge 34. As best shown in FIG. 1A, the tapered leading edge 30 of the wide tab 24 has diagonal corners 36. The tapered edge 30, the beveled edge 32, and the diagonal corners 36 serve to guide the tab into a female receptacle and to reduce the positional skill needed to manually connect a male plug to a female receptacle.

FIGS. 2A–2D show another prior art male blade-type electrical plug of the prior art, which is identical to the terminal illustrated in FIG. 1 except that the diagonal corners 36 depicted in FIG. 1A are replaced with rounded corners 38 to ease the connection of male terminals with female terminals. The other parts of plug are the same as those shown in FIGS. 1A–1D and are labeled with the same reference numbers followed by a prime (').

FIGS. 3A–3D illustrate a female electrical receptacle of the prior art, generally designated by the reference numeral 40, which is intended for mating with the wide tab 24, 24' of the male electrical plugs illustrated in FIGS. 1A–1D and 2A–2D. The female receptacle 40 includes a base portion 41 having a longitudinal axis 42 along its length and a lateral axis 43 along its width. The base portion further has an opposite top surface 44 and bottom surface 45, longitudinally opposite ends 46 and 47, and opposite lateral edges 48 and 49. Attached to the base portion at the lateral edges are guide rails or channels 52. The guide rails 52 slide over and embrace a wide tab 24 of a male plug as a male plug 20 and a female receptacle 40 are connected. When the wide tab 24 of the male plug 20 is inserted into the female receptacle 40, the side channels 52 of the female receptacle 40 extend around the lateral side edges 28 of the wide tab 24 to properly guide and position the tab relative to the female receptacle. of course, it is the contacting portions of the male plug and female receptacles that form the electrical connection.

As illustrated in FIGS. 3B and 3C, a typical female electrical receptacle 40 includes a resiliently bowed bridge 54 having a bump or knob 56 formed thereon. As the wide tab 24 of a male plug is inserted into a female receptacle 40, the resilient bridge 54 and the knob 56 of the female receptacle 40 are displaced by the wide tab 24 of the male plug 20 as the tab 24 is connected to the female receptacle. When the wide tab 24 of the male plug 20 is sufficiently enclosed by the side channels 52 of the female receptacle 40, the resilient bridge 54 biases the knob 56 to snap or spring into the hole 26 of the wide tab of the male plug, thereby locking the male plug and female receptacle together and ensuring an electrical connection therebetween. When a male plug 20 and female receptacle 40 are locked together in this fashion, a high extraction force, relative to the insertion force, is required to disengage the female receptacle from the wide tab 24 of the male plug 20 due to the engagement of the knob 56 of the female terminal with the locking hole 26 of the male terminal.

Ideally, male plugs and female receptacles as described above may be connected with a relatively low connection force, while disconnection requires a relatively high force due to the interaction between the bridge 54 and the knob 56 with the locking hole 26 of the tab 24 of the male plug 20. But plugs and receptacles of the prior art have failed to achieve this goal. It has been found that the required connection force of the plugs and receptacles described above is surprisingly high for assembly workers who must connect the terminals manually. Contact between the resilient bridge 54 and knob 56 of the female terminal receptacle 40 with the top surface of the wide tab 24 of the male plug 20 produces frictional forces and tight fits that significantly increase the required insertion force to engage the bridge and knob of the female receptacle with the locking hole 26 of the male plug. Small burs which may be formed on the leading edge 30 of the wide tab 24 in stamping the male plug from sheet metal, and/or burs formed during the beveling of the beveled edges 32 and 34 (See FIG. 1D) further intensify an already difficult task of connecting the plugs and receptacles, as the burs have a tendency to engage with the bridge 54 and knob 56 of the female receptacle 40 during the connection process, often with a cutting action. The combination of the bridge resistance against the wide tab of the male plug, small burs, and friction result in sticking problems that often require large forces to overcome.

The resultant magnitude of the connection force needed to connect the male plug and female receptacles has many deleterious effects. It may result in injury to the hands or wrists of manufacturing personnel, and may compromise quality control in terminal assembly operations. The large amount of force required for one to manually force the female receptacle over the wide tab of the male plug can result in the onset of carpal tunnel syndrome, and the difficulty and discomfort of forcing the female terminal over the male terminal can undesirably motivate manufacturing personnel to solve this problem in ways which compromise the electrical connection and endanger workers, such as lubricating the male and/or female terminals, and altering of the male and/or female terminals to reduce the required connection force. Beveled leading edges and diagonal or rounded corners of the male electrical plug tabs of the prior art have proven an inadequate solution to these problems.

SUMMARY OF THE INVENTION

Among the several objects of the present invention may be noted the provision of a male electrical terminal plug which may be manually connected with modest force to a female electrical terminal receptacle to establish an electrical connection between the male plug and the female receptacle; and the provision of a male electrical terminal plug which engages a female electrical terminal receptacle so as to require a disconnection force significantly higher than the connection force.

Generally, the male electrical terminal plug of the present invention comprises a tab having opposite top and bottom surfaces, longitudinally opposite distal and proximate ends, and laterally opposite side ends or edges. Similar to the plugs of the prior art, the plug of the present invention includes beveled leading edges and chamfered corners to ease positioning problems between the male plug and female receptacle. The top and bottom surfaces of the tab are generally flat except for a portion of the top surface area between the opposite lateral side edges the distal end of the tab. This portion is sloped or angled relative to the remaining portion of the tab top surface and slopes downwardly from the top surface as it extends from a base portion of the tab toward the distal end of the tab. Hence the male plug of the present invention incorporates a ramp in the top surface of the tab that is positioned to pass over the knob of the female receptacle to enable a smooth and relatively easy connection to the female receptacle.

By providing the ramp in the distal end of the male tab of the plug by providing the knob of the female receptacle does not contact the top surface of the tab immediately as the tab is inserted into the female receptacle. Rather, the knob clears the distal end of the tab, thereby avoiding the sticking or hang-up problems of the prior art attributable to small burs on the male tab.

The invention, like the prior art, has a locking hole near the center of the tab to lockingly receive the knob of the female terminal as shown in FIG. 3 and as described above. The sloped ramp, which is stamped into the tab of the male terminal plug, gradually engages and displaces the resilient bridge and knob of the female receptacle as the male plug is pushed into the receptacle. Consequently, the force required to connect the plug to the receptacle is also "ramped" (i.e., steadily increasing) as the knob of the female receptacle approaches the locking hole of the male plug. The abrupt force and sticking problems of the prior art are thus avoided, thereby considerably reducing the frustrations of manufacturing personnel.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1A:
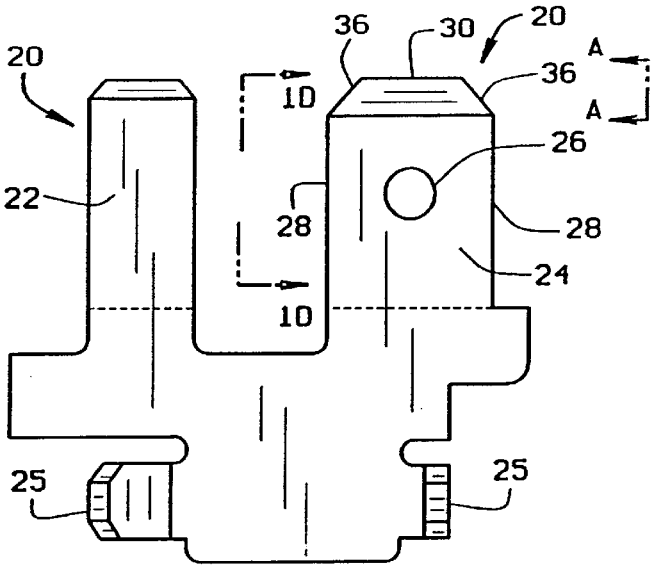
FIG. 1A PRIOR ART
FIGS. 1A–1D illustrate a male electrical terminal plug of the prior art.
Figure 1C:
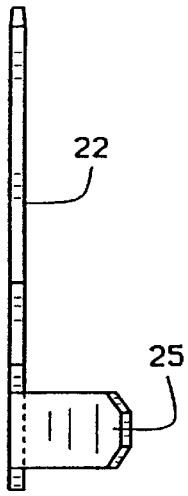
FIG. 1C PRIOR ART
Figure 1B:
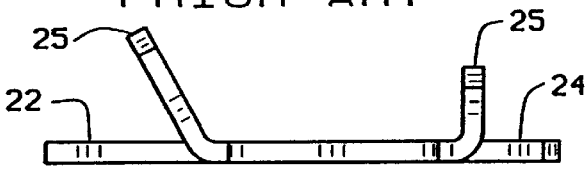
FIG. 1B PRIOR ART
Figure 1D:
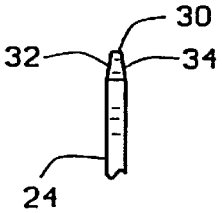
FIG. 1D PRIOR ART
Figure 2A:
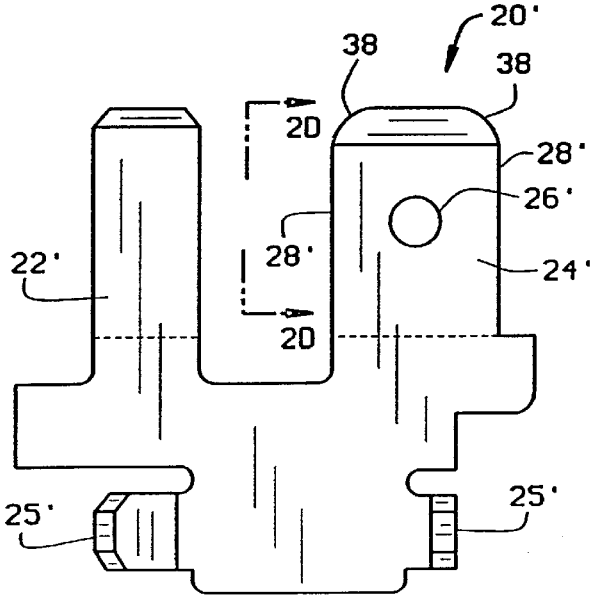
FIG. 2A PRIOR ART
FIGS. 2A–2D illustrate another male electrical terminal plug of the prior art.
Figure 2C:
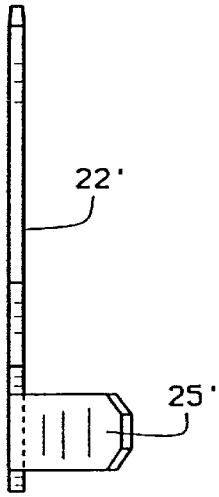
FIG. 2C PRIOR ART
Figure 2B:
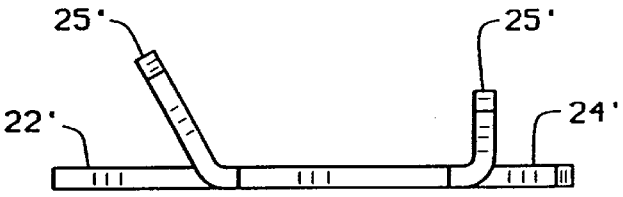
FIG. 2B PRIOR ART
Figure 2D:
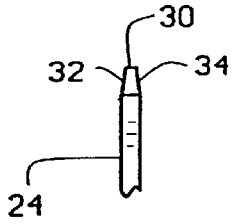
FIG. 2D PRIOR ART
Figure 3A:
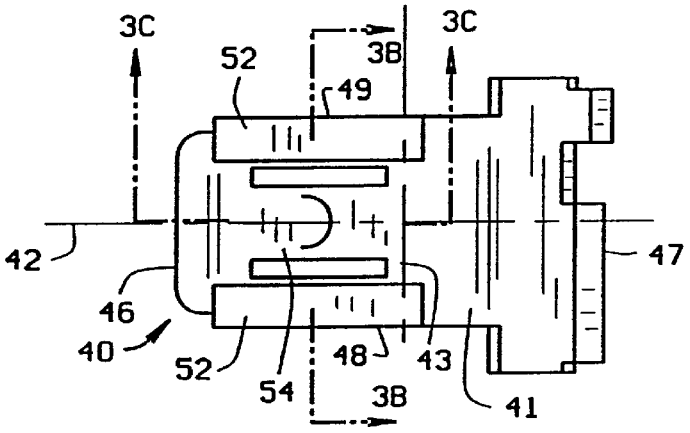
FIG. 3A PRIOR ART
FIGS. 3A–3D illustrate a female electrical terminal plug of the prior art.
Figure 3B:
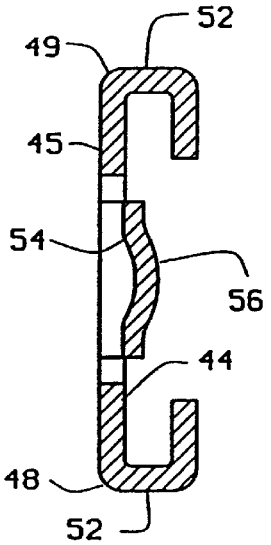
FIG. 3B PRIOR ART
Figure 3C:
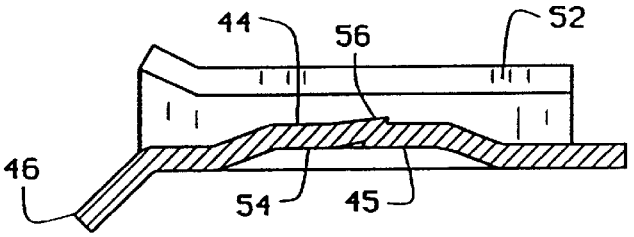
FIG. 3C PRIOR ART
Figure 3D:
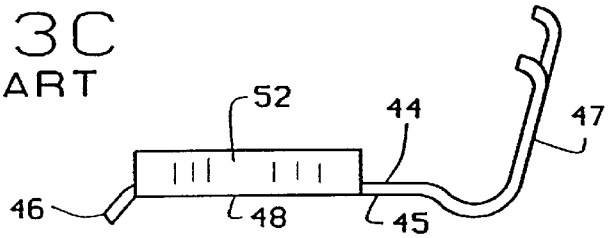
FIG. 3D PRIOR ART

Referring now to the drawings, a male electrical terminal plug according to the present invention is illustrated in FIG. 4. As shown therein in FIG. 4A, the male terminal plug 60 includes a narrow tab 62 and a wide tab 64 as do the prior art male electrical terminal plugs depicted in FIGS. 1 and 2. The plug is shown as a two tab plug for illustration purposes only and the concept of the invention may also be applied to a single tab plug. The ramp plug portion of the invention is employed on the wide tab 64 and only this tab will be described in detail. The wide tab 64 has a longitudinal axis 63 along with its length and a lateral axis 65 along its width. As FIGS. 4A and 4C illustrate, the wide tab 64 has an opposite top surface 66 and bottom surface 68, opposite lateral side edges 70, and a longitudinally proximate end 72 opposite a longitudinally distal end 74. It should be understood that the designation of top and bottom surfaces herein is made arbitrarily and for purposes of illustration and explanation only.

The wide tab 64 is properly dimensioned and shaped as to snugly engage a female receptacle 40 such as that shown in FIG. 3 and described above. It is further to be understood that while some variation exists in female terminal receptacle structures, especially in the structure of the resilient bridge 56, the present invention is fully compatible with different variations of female receptacles. Specifically, resilient bridges exist that are to be aligned along the longitudinal axis of the wide tab of the male plug when the male plug and female receptacles are connected, while other bridges exist that are to be aligned along the lateral axis of wide tab of the male plug when the male plug and female receptacle are connected. The invention is in no way intended to be limited in application with the specific structure of the female terminal disclosed herein.

Figure 4A:
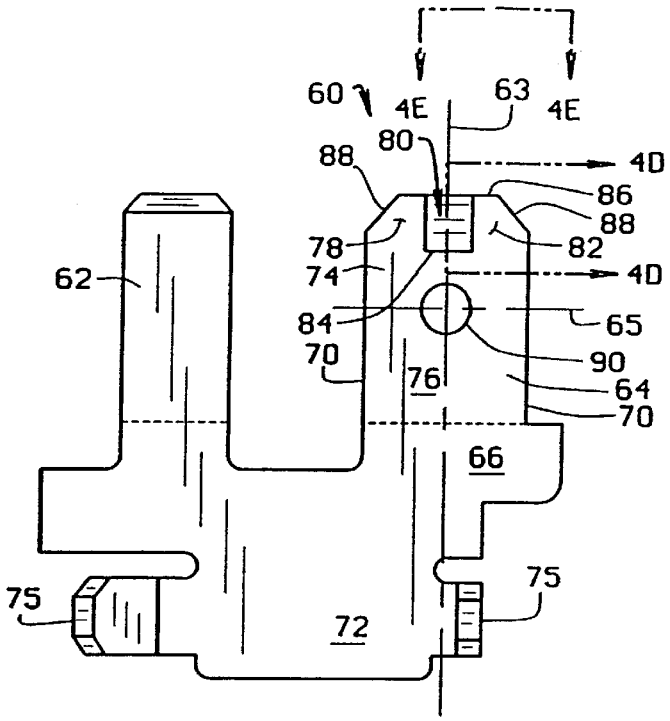
FIGS. 4A–4E illustrate a male electrical terminal plug with on-ramp according to the present invention.
Figure 4C:
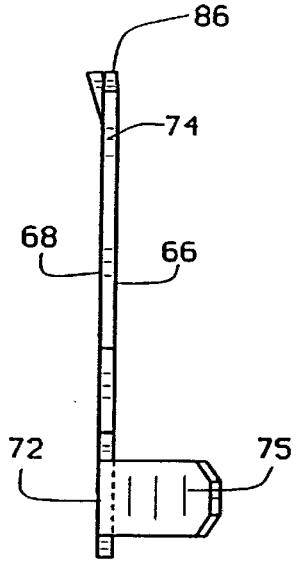
Figure 4B:
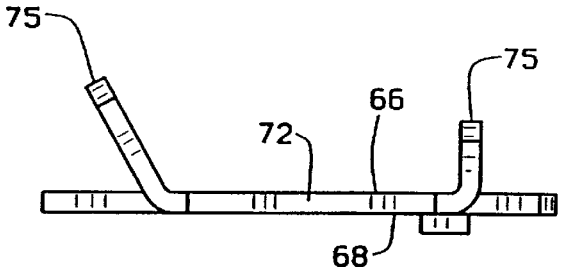

As shown in FIG. 4A and 4B, the proximal end 72 of the tab 64 includes means for attachment to an electrical conductor in the form of a pair of upwardly projecting tabs 75 that could receive female connectors or could have conductors soldered directly thereto. As shown in FIG. 4A and 4C, adjacent the proximal end 72 is a base portion 76 of the tab on which the top 66 and bottom 68 surfaces are parallel and the tab is of uniform thickness. The distal end 74 has a first portion 78, a second portion 80, and a third portion 82 positioned between the lateral side edges 70 of the tab 64 and extending longitudinally from the base portion 76 of the tab.

Figure 4D:
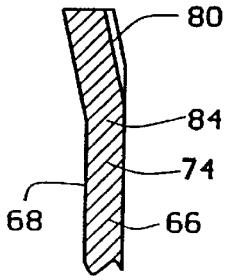

As is evident from FIG. 4A, the first portion 78 is laterally adjacent the second portion 80, and the third portion 82 is laterally adjacent the second portion so that the second portion is positioned between the first and third portions. Consequently, the second portion 80 is laterally spaced from the lateral side edges 70. A bend line 84 extends laterally across the tab 64 between the first 78 and third 82 portions of the tab distal end 74. The bend line 84 separates the base portion 76 of the tab 64 from the second portion 80 of the tab distal end. As best illustrated in FIGS. 4C and 4D, the top surface 66 of the second portion 80 forms a ramp (an "on-ramp"), and is consequently oriented at an angle (or sloped) relative to the coplanar top surfaces of the first 78 and third 82 portions of the tab distal end 74 and the top surface of the tab base portion 76. The first, second and third portions 78, 80, 82 of the distal end 74 are dimensioned to be insertable into an electrical terminal female receptacle 40 such as that shown in FIG. 3.

Specifically, the dimensions and slope of the second portion 80 enable the first 78 and third 82 portions of the distal end 74 to contact the side rails 52 of the female receptacle 40 without the knob 56 of the female receptacle contacting the top surface of the second portion as the tab is first inserted into the female receptacle. In this manner, any potential interference from burs is completely avoided. Further, because the ramp of the second portion 80 is stamped into the distal end 74 of the tab 64, the surface of the ramp is smooth and minimizes frictional forces to impede the progress of the knob 56 as the tab 64 is inserted into the female receptacle 40.

Figure 4E:
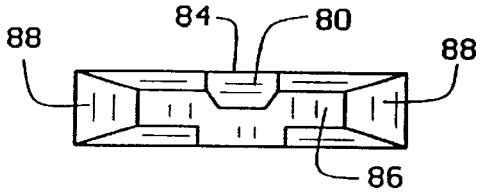

As FIGS. 4A, 4C and 4E illustrate, the ramp of the second portion 80 extends longitudinally from the bend line 84 to the beveled leading edge 86 of the distal end 74. The leading edge 86 also has chamfered corners 88 to facilitate positioning of the tab 64 relative to the side rails 52 of the female receptacle 40. The second portion 80 slopes away from the first 78 and third 82 portions as it extends toward the leading edge 86 of the distal end 74 from the bend line 84. In other words, the ramp slopes downward relative to the first 78 and third 82 portions from the bend line 84 to the leading edge 86 of the distal end 74 of the tab 64. The ramp is positioned to underlie the resilient bridge 54 and knob 56 of the female electrical terminal receptacle 40 as the male plug 60 and female receptacle are connected.

Once the knob 56 on the female 40 terminal clears the tab leading edge 86, the knob rides up the ramp and, due to the resilient bias of the bowed bridge 54, eventually snaps into a locking hole 90 that extends through the tab 64. It should also be understood that due to the length of the tab second portion 80, the bridge 54 and knob 56 on the female terminal 40 are gradually, rather than abruptly, displaced until the knob 56 snaps into the locking hole.

For all of these reasons, the male electrical terminal plug of the present invention significantly decreases the connection force required for mating with the female terminal receptacle as compared to the male terminal plugs of the prior art, while desirably requiring the same relatively high extraction force as plugs of the prior art.

While the present invention has been described by reference to a specific embodiment, it should be understood that modifications and variations of the invention may be constructed without departing from the scope of the invention defined in the following claims.

What is claimed is:

1. A male plug insertable into a female receptacle to establish an electrical connection between the male plug and female receptacle, the male plug comprising:

a tab having opposite top and bottom surfaces, laterally opposite side edges and longitudinally opposite proximal and distal ends, the distal end of the tab having a leading edge adapted to facilitate insertion of the plug into a female receptacle;

the proximal end of the tab having means for attaching an electrical conductor to the tab; and the tab having first and second portions at the leading edge of the tab, the tab first and second portions being positioned between the laterally opposite side edges and laterally adjacent each other and are oriented at an angle relative to each others;

wherein the tab second portion top surface slopes away from the tab first portion top surface as the second portion top surface extends toward the distal end of the tab.

2. The male plug of claim 1, wherein the top surface of the tab first portion is positioned in a first plane and the top surface of the tab second portion is positioned in a second plane, and the first and second planes are oriented at an angle relative to each other.

3. The male plug of claim 1, wherein both the first and second portions of the tab are dimensioned to be insertable into the female receptacle.

4. The male plug of claim 1, wherein the tab has a bevel along its distal end.

5. The male plug of claim 1, wherein the tab has a third portion and the tab first and third portions are positioned between the laterally opposite side edges and on laterally opposite sides of the tab second portion, and the top surface of the tab first portion is coplanar with the top surface of the tab third portion.

6. The male plug of claim 5, wherein the top surface of the tab second portion is oriented at an angle relative to the top surfaces of the tab first and third portions.

7. The male plug of claim 1, wherein the tab has a base portion adjacent its proximal end, the tab top and bottom surfaces at the base portion are parallel to each other, and the tab first and second portions extend longitudinally from the base portion.

8. The male plug of claim 7, wherein the tab top surface at the base portion is coplanar with the tab top surface at the first portion and is angled relative to the tab top surface at the second portion.

9. The male plug of claim 8, wherein a bend line extends laterally across the tab, and the tab base portion and second portion are positioned on longitudinally opposite sides of the bend line.

10. The male plug of claim 5, wherein a bend line extends laterally across the tab between the tab first and third portions and the tab second portion extends longitudinally from the bend line.

11. The male plug of claim 1, wherein a bend line extends laterally across the tab between the opposite side edges, and the tab second portion extends longitudinally from the bend line to the distal end of the tab.

12. The male plug of claim 11, wherein the bend line is spaced longitudinally from the tab proximal and distal ends and is spaced laterally from the tab opposite side edges.

13. The male plug of claim 1, wherein the tab second portion is spaced longitudinally from the tab proximal end and is spaced laterally from the tab opposite side edges.

14. The male plug of claim 11, wherein the bend line lies in a plane of the tab second portion top surface.

15. The male plug of claim 7, wherein the tab has a third portion that is laterally adjacent the second portion and the top surface of the tab third portion and the top surface of the tab second portion are oriented at an angle relative to each other.

16. The male plug of claim 15, wherein the top surface of the tab first portion and the top surface of the tab third portion are coplanar.

17. The male plug of claim 15, wherein the tab first portion and the tab third portion are positioned on laterally opposite sides of the tab second portion.

18. The male plug of claim 15, wherein the tab third portion projects longitudinally from the tab base portion.

19. The male plug of claim 15, wherein the top surface of the tab base portion is coplanar with the top surface of the tab first portion and the top surface of the tab third portion and is oriented at an angle relative to the top surface of the tab second portion.

20. In combination with the male plug of claim 1, a female receptacle comprising:

a base having opposite top and bottom surfaces, longitudinally opposite ends, opposite lateral edges and a resilient bridge;

a guide rail attached to each of the lateral edges adapted for engagement with a male plug; and a knob connected to the bridge adapted for engagement with a locking hole of a male plug.

* * * * *